US005458058A

United States Patent [19]

Zeronian et al.

[11] Patent Number: 5,458,058

[45] Date of Patent: Oct. 17, 1995

[54] REFUSE PACKER ASSEMBLY

[75] Inventors: Gregory J. Zeronian, Pasadena; Kosti Shirvanian, Ladera Heights, both of Calif.

[73] Assignee: Western Waste Industries, Torrance, Calif.

[21] Appl. No.: 196,408

[22] Filed: Feb. 15, 1994

[51] Int. Cl.[6] ..... B30B 7/00

[52] U.S. Cl. ..... 100/233; 100/271; 414/525.2

[58] Field of Search ..... 100/100, 233, 100/270, 271; 414/525.2–525.55

[56] References Cited

U.S. PATENT DOCUMENTS

| | | | |
|---|---|---|---|
| 2,252,608 | 8/1941 | Ballert | 414/525.5 X |
| 3,220,577 | 11/1965 | Laverne | 100/233 X |
| 3,539,061 | 11/1970 | Burgess | 100/233 X |

FOREIGN PATENT DOCUMENTS

| | | | |
|---|---|---|---|
| 0492699 | 7/1992 | European Pat. Off. | 414/525.2 |
| 471774 | 2/1929 | Germany | 414/525.3 |
| 2519931 | 10/1976 | Germany | 100/233 |
| 2138386 | 10/1984 | United Kingdom | 414/525.2 |

*Primary Examiner*—Stephen F. Gerrity
*Attorney, Agent, or Firm*—Noel F. Heal

[57] ABSTRACT

A device for packing or compressing refuse material into a container, which my be mounted on a vehicle or installed at a fixed site. The device includes a paddle mounted for oscillatory angular motion about a generally vertical axis in a hopper assembly. The paddle is oscillated by a crank arm mounted on the same axis and in a fixed angular relationship with the paddle. The crank arm, in turn, is driven by a pair of extensible devices, such as hydraulic cylinders, which are pivotally coupled to the crank arm and pivotally anchored by their other ends to selected points on the hopper frame. The selection of anchor points for the hydraulic cylinders assures that they act in unison over much of the range of oscillatory motion of the paddle, compressing the refuse repeatedly on alternate sides of the container. In one version of the device, the crank arm and the paddle are aligned in identical angular orientations and the cylinders push in unison to compress the refuse. In another disclosed embodiment, the crank arm and the paddle are aligned in diametrically opposite directions and the cylinders push in unison to compress the refuse.

9 Claims, 6 Drawing Sheets

REFUSE PACKER ASSEMBLY

BACKGROUND OF THE INVENTION

This invention relates generally to apparatus for the collection and compaction of refuse or garbage and, more particularly, to devices for the compaction of refuse on collection vehicles or at collection sites. The collection and disposal of refuse from residences and businesses is performed more efficiently if the collected waste material can be packed or compacted as soon as possible. In collection vehicles and in stationery collection boxes, various compaction mechanisms have been employed, with varying degrees of success. One type uses a hydraulically powered ram to force the waste material toward one end of a container. Another type, with which the invention is concerned, uses an oscillating paddle to compress the material on alternate sides of the container or hopper.

Previous oscillating paddle designs for packers have been excessively heavy, or required complicated control mechanisms, or did not provide a large enough packing force. Some prior systems used a rack and pinion mechanism to actuate the packing paddle, but this approach is costly in terms of both weight and initial cost. Other designs have used two actuating hydraulic cylinders, only one of which is active at any time, but this results in an uneven torque being applied to the paddle. It will be appreciated from the foregoing that there is still a significant need for improvement in the design of paddle-type refuse packer assemblies. The present invention satisfies this need.

SUMMARY OF THE INVENTION

The present invention resides in a refuse packing mechanism that achieves efficient compression of refuse material in a container, which may be mounted on vehicle or installed at a fixed site. Briefly, and in general terms, the mechanism of the invention comprises a refuse hopper assembly in which refuse is deposited for packing into an adjoining refuse container; a packing paddle rotatable about a generally vertical axis extending through the hopper; a crank arm mounted for rotation about the same axis in a fixed angular relationship with the paddle; two extensible devices each having first and second ends, wherein the first ends are pivotally connected to the crank arm and the second ends are pivotally anchored to spaced-apart pivot points on the hopper assembly; and means for actuating the extensible devices cyclicly to produce an oscillating motion in the crank arm and the paddle. The paddle is displaced through a total angle of approximately 180° and oscillates through this angular displacement to compress the refuse material repeatedly into the container.

More specifically, the pivot points on the hopper assembly are located symmetrically with respect to a central position of the crank arm, and are selected such that the extensible hydraulic devices act in unison over most of the angular displacement of the paddle, and act in opposition only during a transition phase as the paddle is moved through the central position. In one preferred configuration, the paddle and the crank arm always have the same angular orientation, and the extensible devices function to push the crank arm in unison during packing operations. In another preferred configuration, the paddle and the crank arm always have diametrically opposite angular orientations, and the extensible devices function to push the crank arm in unison during packing operations. The extensible devices are hydraulic actuated cylinders in the illustrative embodiments.

Even more specifically, the mechanism of the invention can be defined as including a refuse hopper assembly in which refuse is deposited for packing into an adjoining refuse container, the hopper assembly including a frame, a bottom wall supported on the frame, and generally semi-cylindrical wall adjoining the bottom wall; and further including a generally vertical rotatable shaft extending through the bottom wall, a packing paddle coupled to the shaft above the bottom wall, and a crank arm coupled to the shaft below the bottom wall and oriented in a fixed angular relationship with the paddle. Further, the mechanism includes two extensible hydraulic devices each having first and second ends, wherein the first ends are pivotally connected to the crank arm and the second ends are pivotally anchored to spaced-apart pivot points on the hopper frame, and means for actuating the extensible hydraulic devices cyclicly to produce an oscillating motion in the crank arm and the paddle, wherein the paddle is displaced through a total angle of approximately 180° and oscillates through this angular displacement to compress the refuse material repeatedly into the container.

It will be appreciated from the foregoing that the present invention represents a significant advance in the field of collection and compaction of refuse. In particular, the invention provides a highly efficient paddle-type of refuse packing device in which two hydraulic cylinders operate in unison over the more significant portions of the oscillatory movement of the paddle. The invention achieves greater compaction of refuse than prior techniques, and does so using a lighter and much less costly device.

DESCRIPTION OF THE PREFERRED EMBODIMENTS

Figure 1:
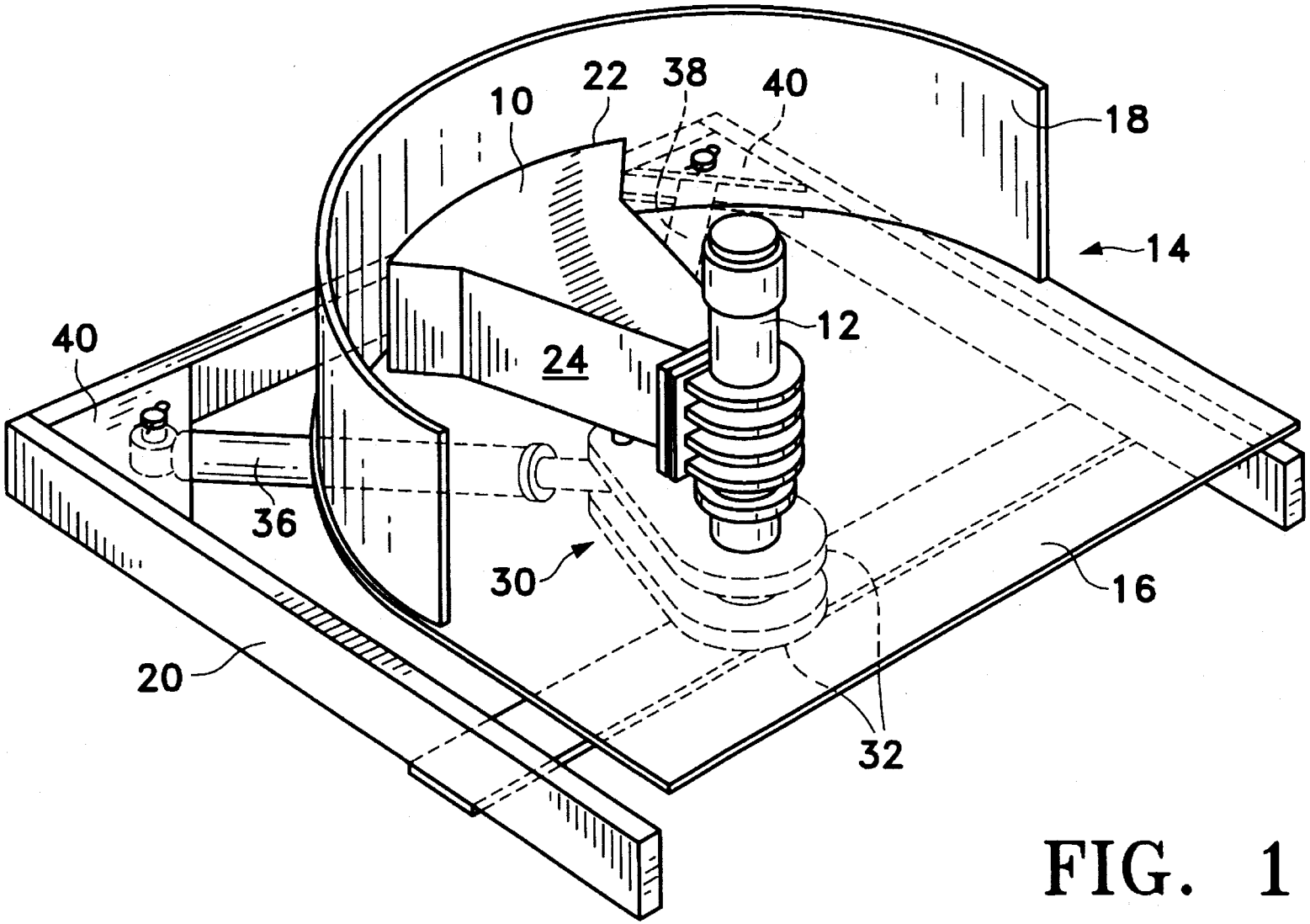
FIG. 1 is a perspective view of a refuse packer assembly in accordance with the invention, with an oscillating paddle shown in its central position.

As shown in the drawings for purposes of illustration, the present invention pertains to a refuse packing assembly of the type that employs an oscillating paddle to compress or pack waste material into a container. The container may be mounted on a collection vehicle or located in a refuse collection site. In the past, paddle operated refuse packers have been expensive, cumbersome, and not very efficient.

Figure 2:
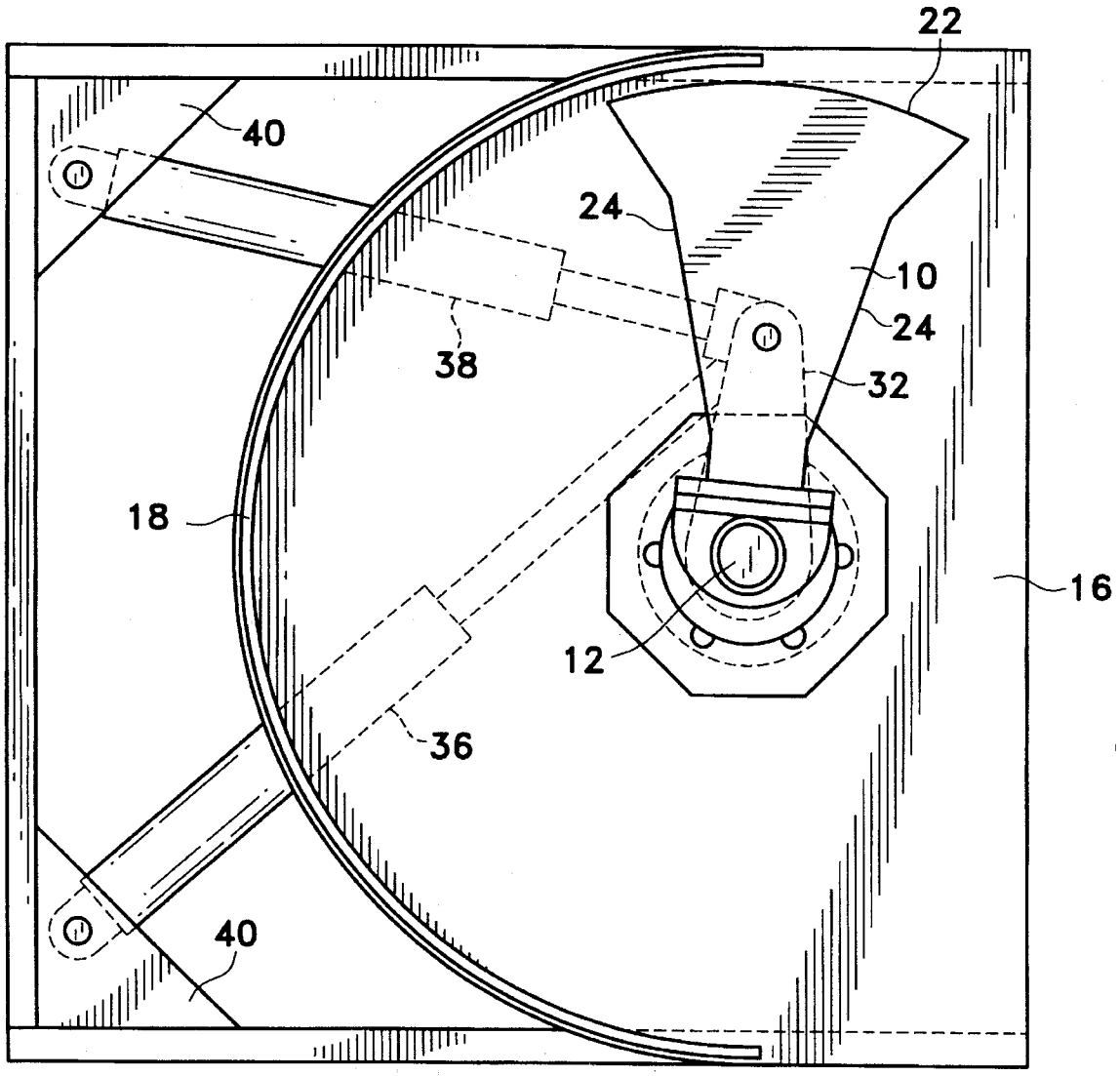
FIG. 2 is a plan view of the packer assembly of FIG. 1, the oscillating paddle shown in an extreme position at one end of its rotational travel.

The refuse assembly of the present invention has rotatable paddle that is actuated by two hydraulic cylinders acting in unison over practically the entire range of motion of the paddle. FIGS. 1 and 2 depict a presently preferred embodiment of the invention. The paddle, indicated by reference numeral 10 is mounted for rotational movement on a vertical shaft 12, which extends up through a refuse hopper 14. The hopper 14, only portions of which are shown, includes a bottom wall 16, in which the shaft 12 is journaled for rotation, a semicylindrical wall 18 adjoining the bottom wall and partially surrounding the paddle 10 and shaft 12, and a hopper frame 20 supporting the bottom wall and the shaft.

More specifically, the paddle 10 has a part-cylindrical outer face 22 having a radius slightly less than that of the semicylindrical wall 18, and has sidewalls 24 adjoining the outer face and extending in toward the shaft 12. As viewed from above, the paddle 10 has the shape of a sector of a circle, except that the sidewalls 24 are angled more sharply outward near the outer wall 22, to provide a more tapered leading edge of the paddle as it is rotated into the refuse material.

The rotation mechanism includes a crank arm 30 mounted on the shaft 12 beneath the bottom wall 16, for rotation with the paddle 10. As illustrated, the crank arm 30 takes the form of a pair of parallel plates 32 fixed to the shaft 12, each plate having a hole 34 near its outer end. Torque is applied to the crank arm 30 by means of two hydraulic cylinders 36 and 38, both of which are attached by one end to the crank arm by means of a pin (not shown) through the holes 34 in the plates 32. The other ends of the cylinders 36 and 38 are pivotally mounted to the hopper frame 20. In the embodiment of FIGS. 1 and 2, the cylinders 36 and 38 extend under the bottom wall 16 and the semicylindrical wall 18 and are mounted by their ends to two gusset plates 40 in corners of the hopper frame. Thus the cylinders 36 and 38 can move angularly with respect to the hopper frame and with respect to the crank arm 30. It will be understood that term "hydraulic cylinder" is intended to mean a cylinder and piston combination of conventional design. When hydraulic fluid pressure is applied to one side of the piston, the hydraulic "cylinder" increases in length, and when hydraulic fluid pressure is applied to the other side of the piston the "cylinder" decreases in length.

Figure 4:
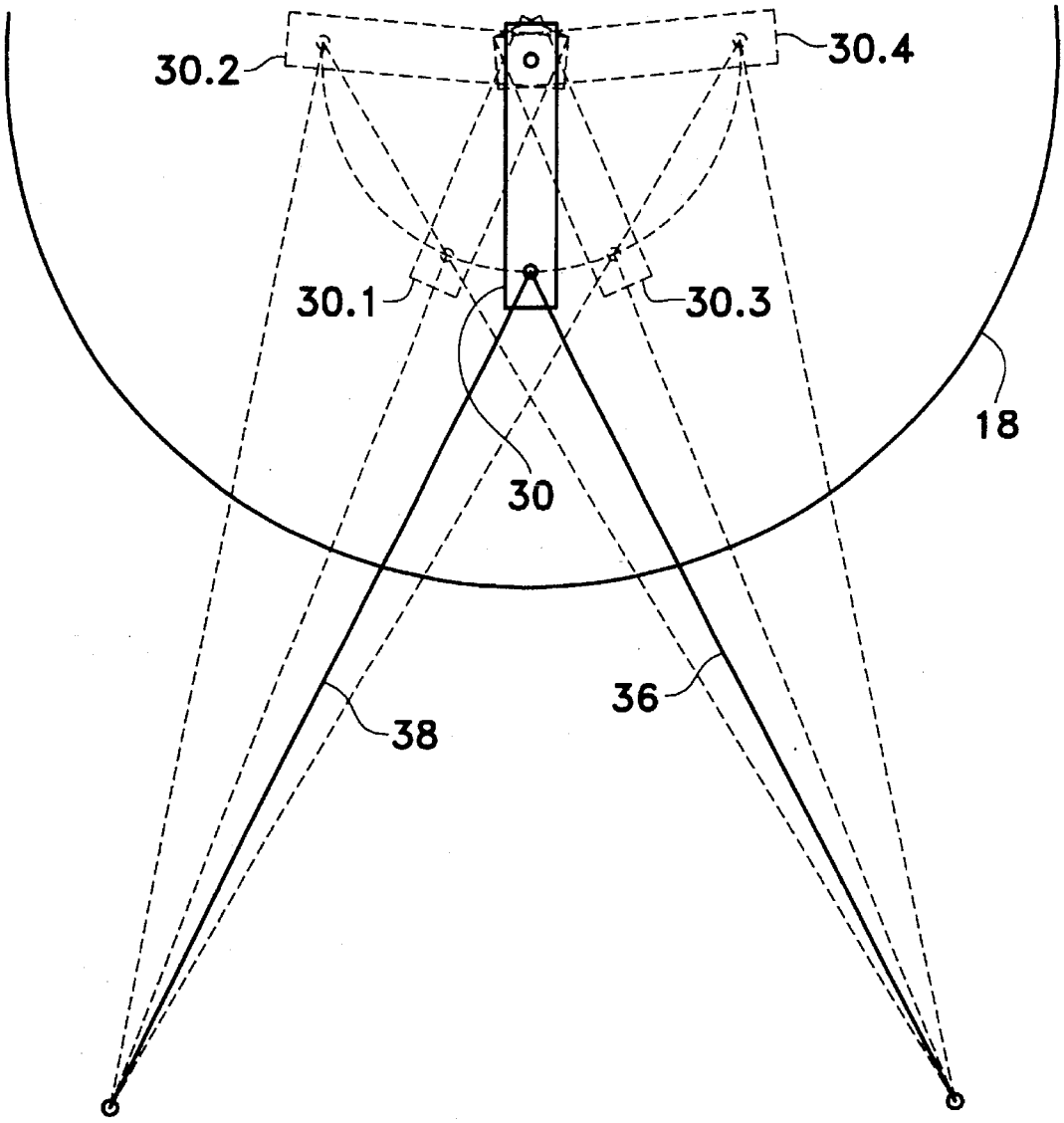
FIG. 4 is a diagrammatic plan view of the packer assembly, shown in multiple angular positions to illustrate a complete cycle of operation.

In the central position of the paddle 10 shown in FIG. 1, the crank arm 30 is angularly aligned with the paddle, and the cylinders 36 and 38 are positioned symmetrically, i.e., they are of equal length and oriented at equal angles relative to the paddle. At this point in the oscillation cycle of the paddle, only one of the cylinders 36 and 38 is actuated to perform a lengthening or pushing function, while the other is actively shortening its length or is passively being shortened as the crank 30 rotates from the central position. For example, and as best seen in FIG. 4, suppose that crank 36 begins pushing at the central position. This will move the crank 30 clockwise until the position indicated at 30.1 is reached. At this point, the crank is aligned with the other cylinder 38. After this point is reached, both cylinders 36 and 38 can contribute to the pushing operation, moving the crank to one of its extreme positions, indicated at 30.2, about 95° from the crank's central position 30. During this part of the paddle oscillation cycle, which requires the greatest compaction force, both cylinders are contributing to the refuse packing operation in a very efficient manner. As the paddle begins to move away from its central position, less force is required because the refuse material is being displaced sideways in the hopper, but during the remaining portion of the paddle's movement the refuse is being compacted toward the end of the hopper away from the semicylindrical wall 18.

Once the extreme position 30.2 of the crank has been reached, both cylinders 36 and 38 are switched to a pull operation and begin to move the paddle back toward its central position. As the position indicated at 30.1 is reached, cylinder 38 switches to a push operation and continues to push the crank 30 through its central position and to the position indicated at 30.3, which is the mirror image of position 30.1. At this point, both cylinders 36 and 38 can push together to complete a compaction stoke on the other side of the hopper 14. When the extreme point of travel on this side of the hopper is reached, as indicated at 30.4, both cylinders 36 and 38 are switched back to a pull operation and the paddle is moved back toward its central position again. When the position at 30.3 is reached, paddle 36 switches from pulling to pushing and the oscillation cycle begins again as the paddle passes through the central position.

Figure 5:
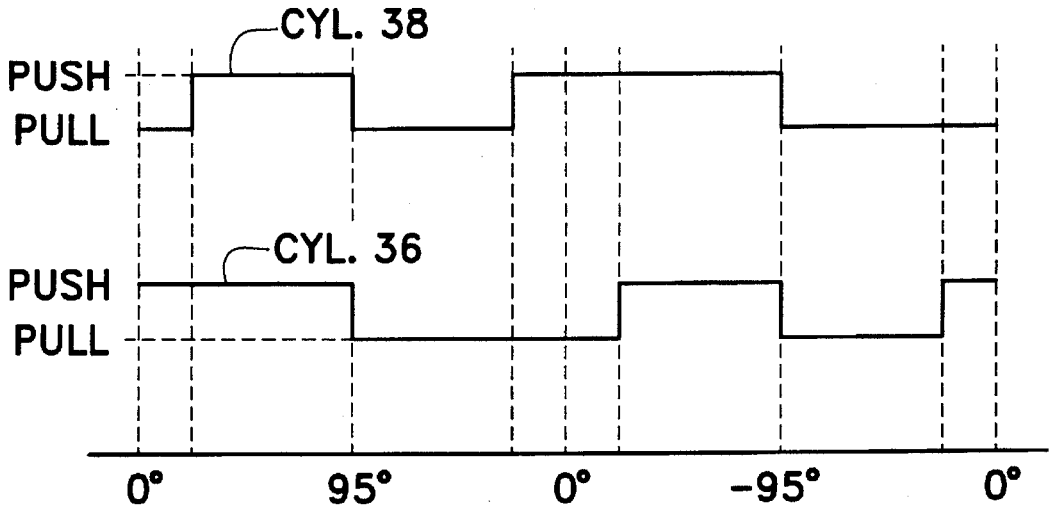
FIG. 5 is a sequencing diagram showing push-pull operation of the actuating cylinders over a complete cycle of operation.

FIG. 5 shows the sequence of pushing and pulling operations for the two cylinders 36 and 38 over a complete cycle of operations, consistent with the foregoing description. The horizontal axis is the angular displacement of the crank 30, with 0° being the central position, +95° being the extreme crank position shown on the left of FIG. 4, and −95° being the extreme crank position shown on the right of FIG. 4.

Figure 6:
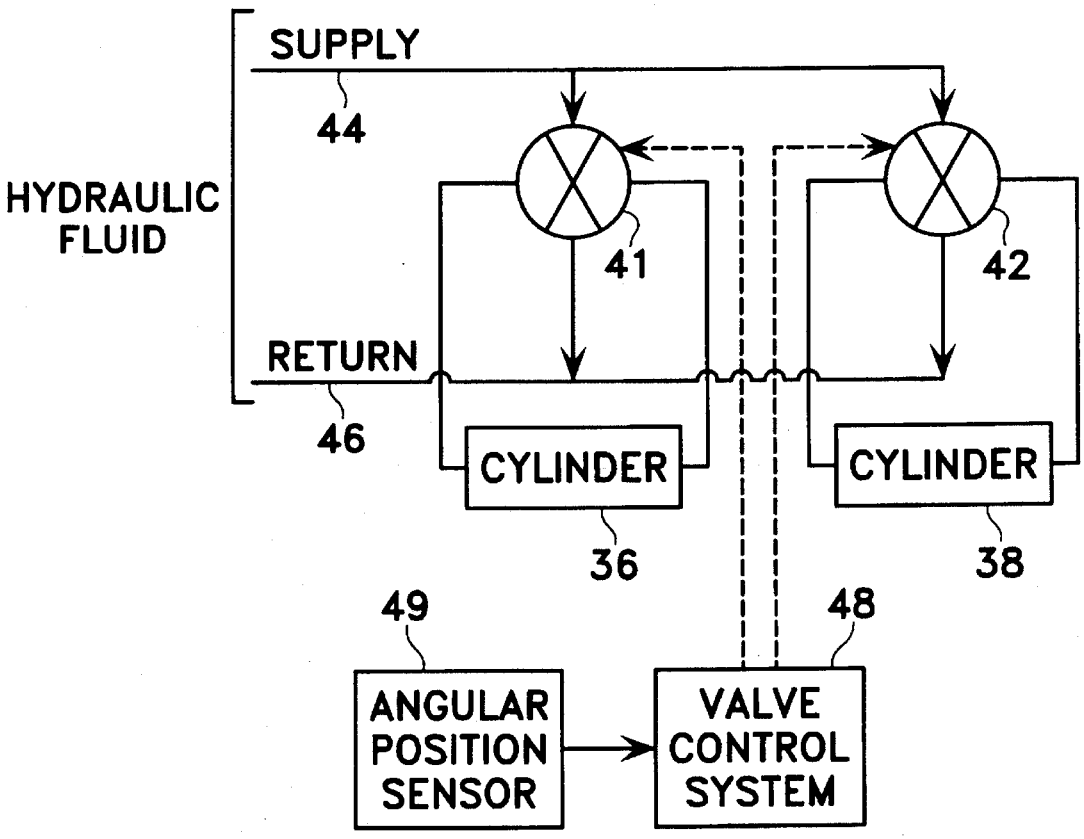
FIG. 6 is a block diagram depicting a control system for the actuating cylinders.

The cylinders 36 and 38 are actuated by a conventional hydraulic control system, which, as shown by way of example in FIG. 6, typically includes valves 41 and 42 for applying hydraulic pressure from lines 44 and 46 to the cylinders 36 and 38, to effect the pushing and pulling operations. Controlling operation of the hydraulic cylinders 36 and 38 may be effected by any conventional control system 48, such as an electronic sequencing device using paddle position information from an angular position sensor 49, to operate the valves 41 and 42 in accordance with the diagram of FIG. 5.

Figure 7:
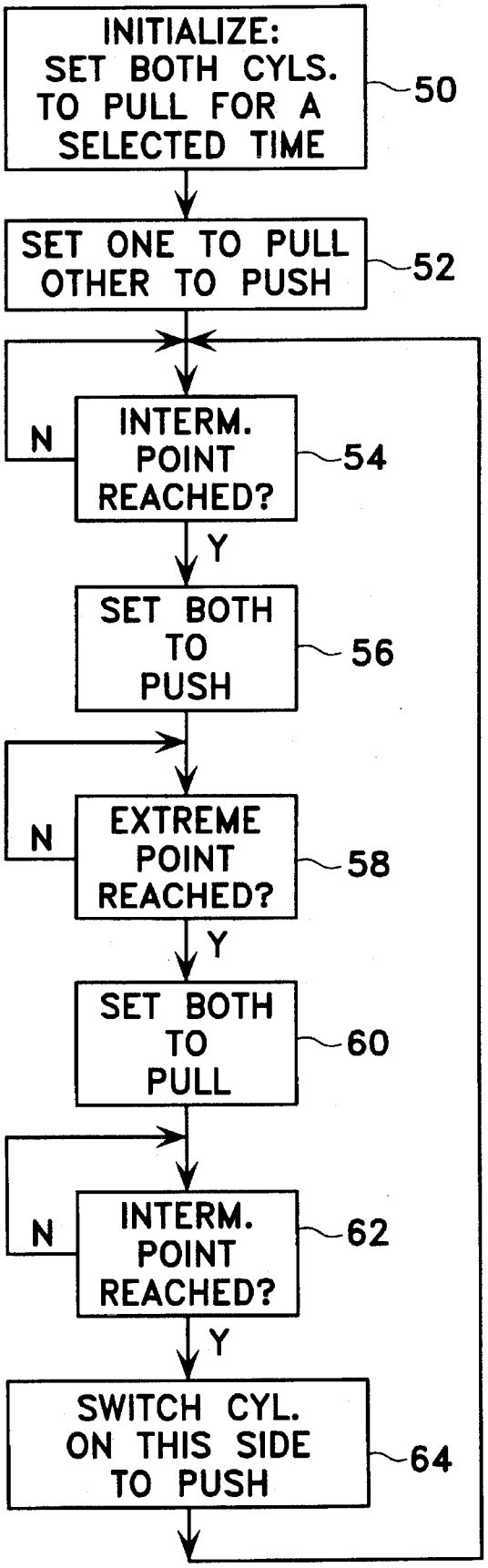
FIG. 7 is a flowchart showing the functions performed by the control system of FIG. 6.

The valve control system 48 functions substantially as shown in the flowchart of FIG. 7. When the packing mechanism is first activated, the paddle 10 is placed in a starting position, such as the central position, by applying pull signals to both cylinders 36 and 38 for a preselected time interval, as indicated in block 50. Once the paddle is in its central position, a push signal is applied to a selected one of the cylinders, as indicated at 52. This starts the paddle rotating away from the central position. The controller then checks continually (as shown in block 54) to determine when the paddle reaches an intermediate position (corresponding to the positions 30.1 and 30.3 in FIG. 4). When this position is reached, both cylinders are put in the push mode, as indicated in block 56. Then the controller checks for arrival at the extreme position, as indicated in block 58, at which point both cylinders are switched to the pull mode, as shown in block 60. The paddle now begins its return motion and the controller starts checking for arrival at the intermediate point again, as indicated in block 62. At this point, the cylinder on the same side that the paddle is currently position is switched to push mode, as indicated in block 64. For example, if the paddle is returning from the extreme position on the left side, it is the left-hand side cylinder that is switched. The paddle next passes through its central position and its status is equivalent to the initial condition that was set in block 52 except that the modes of the two cylinders are reversed. The controller now cycles back to block 54 and begins looking for the intermediate point on the other side of the device.

Figure 3:
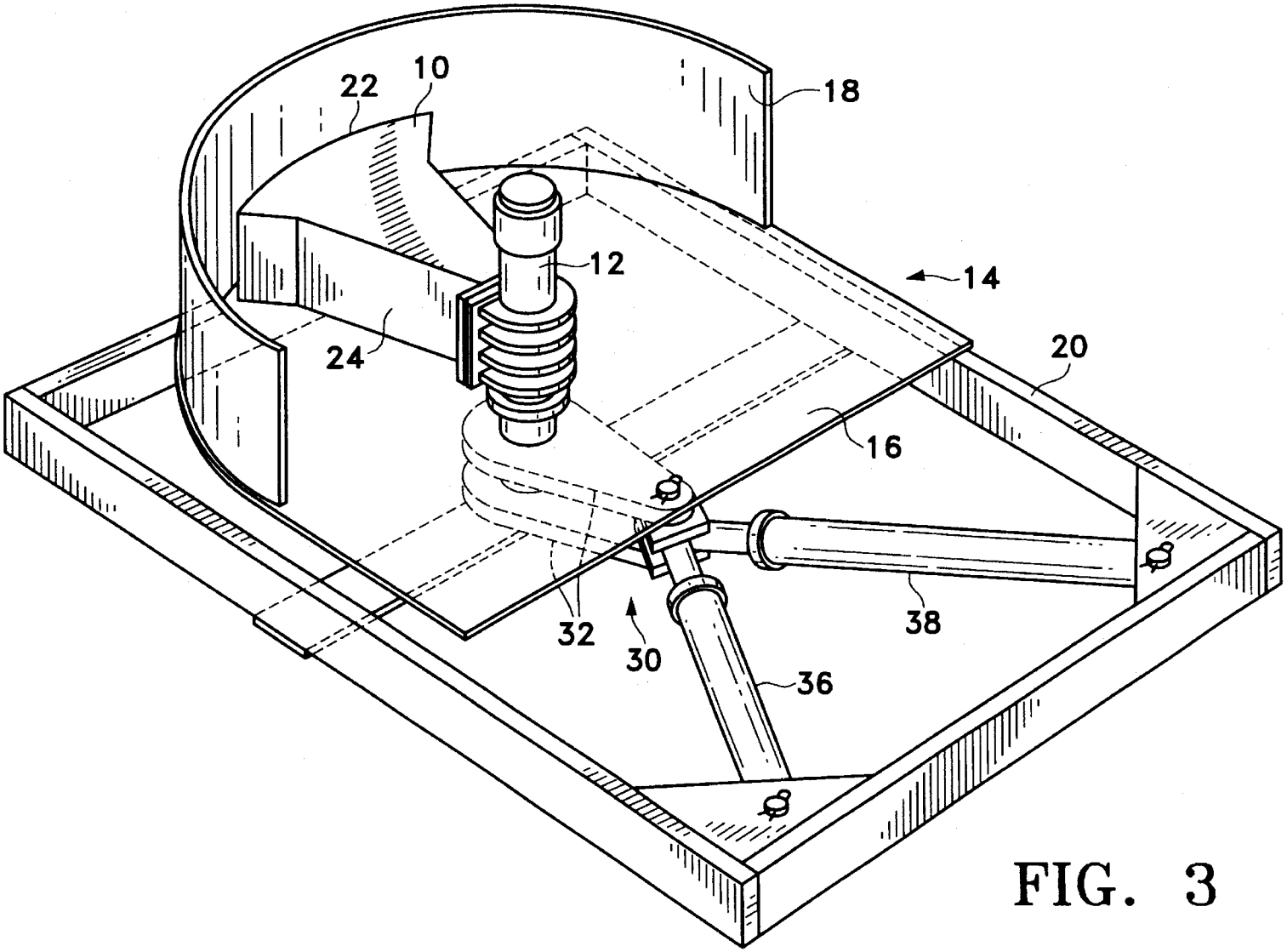
FIG. 3 is a perspective view of an alternative embodiment of the packer assembly, with actuating cylinders oriented in a different relationship with the paddle.

FIG. 3 depicts a slightly different embodiment of the invention, in which the crank 30 is aligned diametrically opposite the paddle 10 and the cylinders 36 and 38 are attached an end of the frame 20 opposite to the one used in the embodiment of FIGS. 1 and 2. In other words, instead of extending under the semicylindrical wall 18 to their anchor points on the frame 20, the cylinders 36 and 38 extend in the opposite direction, away from both the semicylindrical wall 18 and the shaft 12. However, the principle of operation is the same for both embodiments. The cylinders 36 and 38 push in unison over the important portions of the oscillation cycle and compress the refuse material in an extremely efficient manner.

It will be appreciated from the foregoing that the present invention represents a significant advance in the field of refuse packers or compactors. In particular, the packer of the present invention achieves significantly greater compaction factors than previously available packers, and does so with a device that is lighter in weight and less costly by a factor of five or more. In a typical refuse collection truck, use of the invention allows loading of as much as a ton more refuse than could be loaded using previously available equipment.

It will also be appreciated that, although specific embodiments of the invention have been described by way of illustration, various modifications may be made without departing from the spirit and scope of the invention. Accordingly, the scope of the invention should not be limited except as by the appended claims.

What is claimed is:

1. A refuse packing mechanism, comprising:

a refuse hopper assembly in which refuse is deposited for packing into an adjoining refuse container;

a packing paddle rotatable about a generally vertical axis extending through the hopper assembly, wherein the paddle is rotatable through a central position in which the paddle is centrally located in the hopper assembly;

a crank arm mounted for rotation about the same axis in a fixed angular relationship with the paddle;

two extensible devices each having first and second ends, wherein the first ends are pivotally connected to the crank arm at a common pivot axis and the second ends are pivotally anchored to spaced-apart pivot points on the hopper assembly; and means for actuating the extensible devices cyclicly to produce an oscillating motion in the crank arm and the paddle, wherein the paddle is displaced through a total angle of approximately 180° and oscillates through this angular displacement to compress the refuse material repeatedly into the container;

and wherein the pivot points on the hopper assembly are located symmetrically with respect to a central position of the paddle, and are selected such that the extensible devices act in unison over most of the angular displacement of the paddle, and act in opposition only during a transition phase as the paddle is moved through the central position.

2. A refuse packing mechanism as defined in claim 1, wherein:

the paddle and the crank arm always have the same angular orientation;

the extensible devices function to push the crank arm in unison during packing operations.

3. A refuse packing mechanism as defined in claim 1, wherein:

the paddle and the crank arm always have diametrically opposite angular orientations;

the extensible devices function to push the crank arm in unison during packing operations.

4. A refuse packing mechanism as defined in claim 1, wherein:

the extensible devices are hydraulic cylinders.

5. A refuse packing mechanism, comprising:

a refuse hopper assembly in which refuse is deposited for packing into an adjoining refuse container, the hopper assembly including a frame, a bottom wall supported on the frame, and generally semi-cylindrical wall adjoining the bottom wall;

a generally vertical rotatable shaft extending through the bottom wall;

a packing paddle coupled to the shaft above the bottom wall;

a crank arm coupled to the shaft below the bottom wall and oriented in a fixed angular relationship with the paddle;

two extensible hydraulic devices each having first and second ends, wherein the first ends are pivotally connected to a common pivot axis on the crank arm and the second ends are pivotally anchored to spaced-apart pivot points on the hopper frame; and means for actuating the extensible hydraulic devices cyclicly to produce an oscillating motion in the crank arm and the paddle, wherein the paddle is displaced through a total angle of at least approximately 180° and oscillates through this angular displacement to compress the refuse material repeatedly into the container.

6. A refuse packing mechanism as defined in claim 5, wherein:

the pivot points on the hopper frame are located symmetrically with respect to a central position of the paddle, and are selected such that the extensible hydraulic devices act in unison over most of the angular displacement of the paddle, and act in opposition only during a transition phase as the paddle is moved through the central position.

7. A refuse packing mechanism as defined in claim 6, wherein:

the paddle and the crank arm always have the same angular orientation;

the extensible hydraulic devices function to push the crank arm in unison during packing operations.

8. A refuse packing mechanism as defined in claim 6, wherein:

the paddle and the crank arm always have diametrically opposite angular orientations;

the extensible hydraulic devices function to push the crank arm in unison during packing operations.

9. A refuse packing mechanism as defined in claim 6, wherein:

the total range of angular displacement of the paddle is approximately 190°.

* * * * *